United States Patent [19]

Parkyn

[11] 4,070,585

[45] Jan. 24, 1978

[54] STARTER MOTOR LOCKOUT SYSTEM

[75] Inventor: Derek John Parkyn, Westerham, England

[73] Assignee: U.S. Philips Corporation, New York, N.Y.

[21] Appl. No.: 590,441

[22] Filed: June 26, 1975

[30] Foreign Application Priority Data

Feb. 13, 1975 United Kingdom ..... 06151/75

[51] Int. Cl.[2] ..... F02N 11/00

[52] U.S. Cl. ..... 290/37 A; 290/38 R

[58] Field of Search ..... 290/36–38, 290/DIG. 1, DIG. 4, DIG. 5, DIG. 11; 123/179

[56] References Cited

U.S. PATENT DOCUMENTS

| | | | |
|---|---|---|---|
| 3,629,597 | 12/1971 | Wiley | 290/38 |
| 3,857,043 | 12/1974 | Habasch | 290/37 |

FOREIGN PATENT DOCUMENTS

| | | | |
|---|---|---|---|
| 1,325,318 | 8/1973 | United Kingdom | 290/37 R |

*Primary Examiner*—Robert K. Schaefer
*Assistant Examiner*—J. W. Redman
*Attorney, Agent, or Firm*—Frank R. Trifari; Bernard Franzblau

[57] ABSTRACT

An electronic lockout system for the starter motor of an internal combustion engine includes means for operating the starter motor only if the engine flywheel is stationary. The system also includes means for automatically deenergizing the starter motor when the engine achieves a predetermined rotational speed and independently of the continued operation of the starter switch.

9 Claims, 1 Drawing Figure

STARTER MOTOR LOCKOUT SYSTEM

Figure 1:
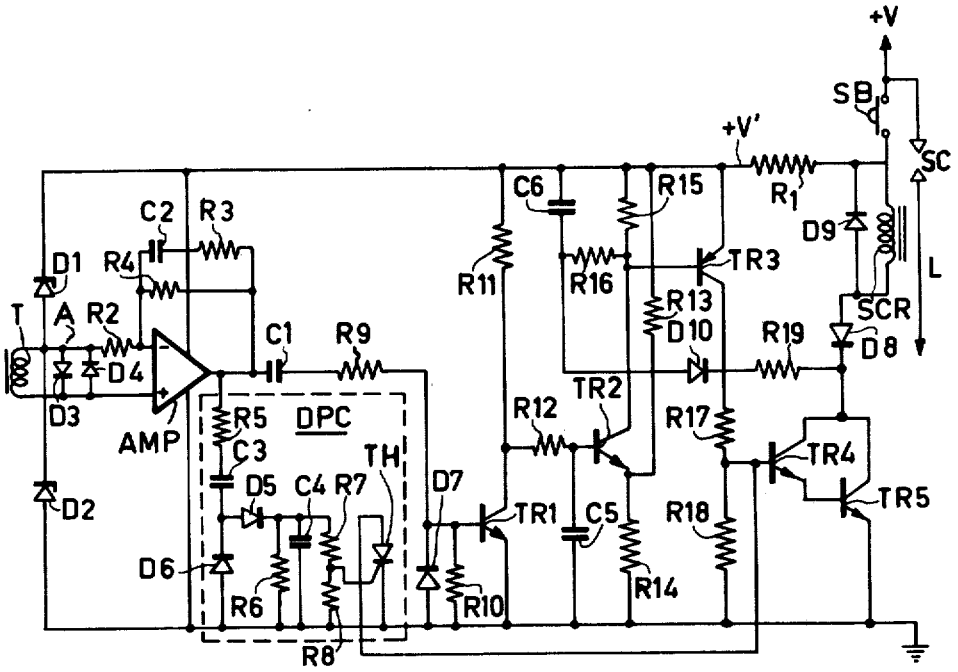

This invention relates to a starter motor lockout system for an internal combustion engine and is an improvement in or modification of the invention forming the subject of a co-pending U.S. patent application Ser. No. 570,617, now U.S. Pat. No. 4,032,792.

According to the present invention, a starter motor lockout system for an internal combustion engine as claimed in said co-pending U.S. patent application includes a frequency-to-d.c. converter circuit which is connected to receive an alternating electric output from a transducer and is responsive when this output has attained a given frequency to produce a d.c. output voltage of a magnitude and polarity appropriate for rendering the semiconductor output stage inoperative and to cause de-energisation of the starter relay and thus the starter motor.

Thus, the system is now arranged to de-energise the starter motor automatically, irrespective of the continued operation of the starter switch, when a predetermined rotational speed of the engine has been attained.

Preferably, a thyristor provided at the output of the converter circuit is responsive to the d.c. output voltage therefrom to establish a bias voltage for maintaining the semiconductor output stage unresponsive, the thyristor terminating this bias voltage only when the starter switch is released.

The frequency-to-d.c. converter circuit is suitably a diode pump circuit.

An embodiment of the invention will how be described, by way of example, with reference to the accompanying drawing the single FIGURE of which shows the electrical and electro-mechanical circuit diagram of a starter motor lockout system according to the invention.

The starter motor lockout system shown in the drawing is suitable for a vehicle with a negative ground and, therefore, one terminal of a starter switch SB of the system is connected to the positive supply line +V of the vehicle. The other terminal of the starter switch SB is connected directly to one end of an auxiliary relay starter coil SCR and via a resistor R1 to a further supply line which is at a voltage of +V′ when the starter switch SB is operated. The voltage +V′ is stabilised by two zener diodes D1 and D2 which are connected in series between this further supply line and ground. The voltage +V′ is the positive voltage for a differential amplifier AMP which is also connected to ground as shown to provide the negative voltage return for said voltage. A point A is connected via a resistor R2 to the negative input terminal of the amplifier AMP and directly to one end of a transducer T which is, for example, an electro-magnetic transducer which detects the movement of gear teeth on the starter ring gear attached to the engine. The other end of the transducer T is connected directly to the positive input terminal of the amplifier AMP. Opposed diodes D3 and D4 are connected in parallel across the transducer T.

The output of the amplifier AMP is connected to one side of a capacitor C1 and to the negative input of amplifier AMP via a feedback loop comprising the parallel combination of a capacitor C2 in series with a resistor R3 and a resistor R4. The output of amplifier AMP is also connected via a resistor R5 and a capacitor C3 to the input of a diode pump circuit DPC comprising diodes D5 and D6, resistors R6, R7 and R8, a capacitor C4 and a thyristor TH.

The other side of capacitor C1 is connected via a resistor R9 to the base of a transistor TR1. The base of transistor TR1 is connected to ground via the parallel combination of a diode D7 and, a resistor R10, its emitter is connected directly to ground. The collector of TR1 is connected to the positive supply line +V′ via a resistor R11 and to the base of a transistor TR2 via a resistor R12. The base of transistor TR2 is connected to ground via a capacitor C5, its emitter is connected to the junction of two resistors R13 and R14 which are connected in series between the positive supply line +V′ and ground, and its collector is connected to the base of a transistor TR3, to the positive supply line +V′ via a resistor R15 and to one side of a capacitor C6 via a resistor R16. The other side of the capacitor C6 is connected to the positive supply line +V′. The transistor TR3 has its emitter connected to the positive supply line +V′ and its collector connected via two resistors R17 and R18 in series to ground. The junction of resistors R17 and R18 is connected to the base of a transistor TR4 which forms a Darlington pair with a transistor TR5. The emitter of transistor TR5 is connected to ground and the commoned collectors of transistors TR4 and TR5 are connected via a diode D8 to the other side of the relay starter coil SCR. A further diode D9 is connected across this coil. The capacitor C6, a diode D10 and a resistor R19 form a series connection between the positive supply line +V′ and the commoned collectors of the transistors TR4 and TR5.

The system operates as follows. When the starter switch SB is operated, the voltage +V′ appears. This voltage is stabilised by the zener diodes D1 and D2 and the bias potential at the point A is stabilised by the zener diode D2. Providing there is no movement of the engine being detected by the transducer T, operating on the starter ring gear, the amplifier AMP will give a zero volts output since the potentials at its positive and negative input terminals will be equal. Transistor TR1 will therefore be off and capacitor C5 will begin to charge slowly through resistors R11 and R12. The circuit values are chosen such that after a time delay of, for example, 2 seconds, the potential at the base of transistor TR2 has risen sufficiently to turn on this transistor. As a result, transistor TR3 is turned on to turn on transistors TR4 and TR5, hence supplying a current to the starter relay coil SCR. Contacts SC of the starter relay are thus closed and a main starter relay or solenoid (not shown) is energised by the voltage +V applied thereto over a lead L via the closed contacts SC. Current is then supplied to the starter motor which will begin to turn the ring gear on the engine. The series connection comprising capacitor C6, diode D10 and resistor R19 forms a latching circuit to ensure that the detection of the movement of the ring gear does not cause the starter contacts SC to be opened. The drop in potential at the commoned collectors of transistors TR4 and TR5 is fed over this latching circuit to the base of transistor TR3 to maintain this transistor conducting and thus transistors TR4 and TR5 turned on.

About 100 m.secs. after this latching potential has been provided, the transducer T detects that the ring gear is moving and supplies a positive voltage to the positive input of the amplifier AMP causing it to produce a positive output voltage which turns on transistor TR1. As a result, capacitor C5 is discharged to ground via the resistor R12 and the emitter-collector path of transistor TR1, so that transistor TR2 will be turned off. However, transistor TR3, and thus transistors TR4 and TR5, will be held turned on by the latching circuit.

Providing that starter switch SB is continuously depressed, and subject to the action of the diode pump circuit DPC to be considered presently, the starter motor will continue to be energised. It will be noted that the output from the transducer T is an alternating voltage which will cause transistor TR1 to turn on and off periodically. However, it is arranged that the rate of charging current supplied via resistors R11 and R12 is so low compared with the rate of discharge current via resistor R12 and the collector-emitter path of transistor TR1, that capacitor C5 will effectively remain discharged towards zero volts.

When the starter switch SB is released, the voltage +V' disappears. The starter relay contacts SC will open after a short delay and the starter motor will be de-energised. The ring gear, due to the weight of the engine fly-wheel, will continue to rotate for some time. Capacitor C6 will be discharging via resistors R15 and R16 which form a shunt path across it. If the starter switch SB is re-operated immediately or only a short time after release, it is arranged that the capacitor C6 will have retained sufficient charge so that the potential at the base of transistor TR3 will turn on this transistor, and thus transistors TR4 and TR5 will turn on again and therefore the starter relay coil SCR will be re-energised and the starter relay contacts SC will close and the starter motor will continue to drive the ring gear. This time is arranged to be very short, of the order of 20 - 30 m.secs., so that an inadvertent release of the starter switch SB does not result in a lockout operation taking place until the time that the starter motor drive pinion may have been disengaged from the ring gear. After this time, however, the voltage at the base of transistor TR3 is not sufficient to cause this transistor to turn on, so that after this time if the starter switch SB is re-operated the starter relay coil SCR will not be energised immediately. The energisation of the starter relay coil SCR will once again be determined by the time taken for capacitor C5 to charge up to the required potential to turn on transistor TR2. This time will of course not commence until the transducer T has detected that the ring gear has stopped moving. A further 2 seconds is then allowed such that any kick-back via the engine will cause the lockout system to operate until the engine finally comes to rest. The period of 2 seconds therefore will operate from the time that the engine finally comes to rest.

Consider now the action of the diode pump circuit DPC. The capacitor C4 therein is charged at a rate determined by the frequency of the output voltage from the amplifier AMP, and acquires a charge which is proportional to this frequency. When a level of charge corresponding to a predetermined frequency of the amplifier output voltage is reached, the voltage at the junction of resistors R7 and R8 attains a value which triggers the thyristor TH. With the thyristor TH triggered, the base of transistor TR4 is clamped to a virtual ground bias potential so that this transistor and transistor TR5 are cut-off to de-energise the starter relay coil SCR. Thus, even with the starter switch SB held operated, the starter motor will be de-energised when the engine speed attains a given value. The action of the diode pump circuit DPC over-rides that of the latching circuit which tends to hold transistors TR4 and TR5 turned on. The thyristor TH will be reset to remove the ground bias potential only when the circuit is de-energised by release of the starter switch SB.

Diode D9 is included to absorb the stored energy released when the starter relay coil SCR is de-energised, thus ensuring that this energy does not cause excessive voltage swings on the collectors of transistors TR4 and TR5.

The circuit elements comprising capacitor C2 and resistors R3 and R4 used to provide feedback for the amplifier AMP serve to define the d.c. gain of the amplifier and to counteract the inherent rising response of the transducer T with an increase in engine speed such that a low output from the transducer T at low rotational speeds of the ring gear is maximised.

In a practical circuit the component values are as follows:

| | | | |
|---|---|---|---|
| | | +V | = 24 volts |
| Zener diodes D1, D2 | | | = type BZY 88 |
| Diodes D3, D4, D5, D6, D7, D10 | | | = type BAX 13 |
| Diode D8 | | | = type in 4003 |
| Diode D9 | | | = type BAX 16 |
| Transistors TR1, TR2 | | | = type BC 108 |
| Transistors TR4, TR5 | | | = type BDX 44 |
| Transistors TR3 | | | = type BCY 70 |
| Resistor R1 = 560 ohms. | | Resistor | R11 = 10 M ohms |
| Resistor R2 = 470 ohms. | | Resistor | R12 = 100 K ohms |
| Resistor R3 = 4.7K ohms. | | Resistor | R13 = 10 K ohms |
| Resistor R4 = 4.7K ohms. | | Resistor | R14 = 4.7 K ohms |
| Resistor R5 = 2.7K ohms. | | Resistor | R15 = 220 K ohms |
| Resistor R6 = 39K ohms. | | Resistor | R16 = 220 K ohms |
| Resistor R7 = 220K ohms. | | Resistor | R17 = 8.2 K ohms |
| Resistor R8 = 22K ohms. | | Resistor | R18 = 10 K ohms |
| Resistor R9 = 15K ohms. | | Resistor | R19 = 100 K ohms |
| Resistor R10 = 1M ohms. | | | |
| Capacitors | C1 = 470 n.farad | | |
| | C2 = 10 n.farad | | |
| | C3 = 10 n.farad | | |
| | C4 = 100 n.farad | | |
| | C5 = 1 μ.farad | | |
| | C6 = 47 n.farad | | |

What we claim is:

1. A starter motor lockout system for an internal combustion engine comprising, a starter switch, a transducer responsive to engine rotation to produce an alternating output signal whose frequency is dependent upon engine speed, time delay means including a capacitor, a semiconductor switch periodically controlled by said output signal and coupled to said capacitor to control the mean charge thereon, means including the starter switch for connecting said capacitor in a charge circuit while the starter switch is operated, means including the semiconductor switch for periodically connecting the capacitor in a discharge circuit at a rate determined by the frequency of said alternating output signal, a semiconductor output stage connected to energize a starter relay when the mean charge on the capacitor exceeds a predetermined value, said value being attained a predetermined time period after the starter switch is operated with the engine at rest and determined by the time constant of the charge circuit, operation of the starter relay being effective to operate contacts for supplying current to a starter motor, a latching circuit coupled to the semiconductor output stage for maintaining said output stage operative while the starter switch is operated, and a frequency-to-DC voltage converter circuit responsive to the transducer alternating output signal and having output means coupled to the semiconductor output stage, said converter circuit being operative when said output signal attains a predetermined frequency to produce a DC voltage of a magnitude and polarity to actuate the output means so as to inhibit operation of the semiconductor output stage thereby to deenergize the starter relay and in turn the starter motor and independently of the continued operation of the starter switch.

2. A system as claimed in claim 1 wherein said output means includes a thyristor device responsive to the d.c. output voltage to establish a bias voltage for maintaining the semiconductor output stage inoperative, the thyristor device being connected in circuit so as to terminate said bias voltage only when the starter switch is released.

3. A system as claimed in claim 1 wherein the frequency-to-d.c. voltage converter circuit comprises a diode pump circuit.

4. A starter motor lockout system for an internal combustion engine comprising, a starter switch, delay means including a capacitor, a semiconductor switch coupled to said capacitor to control the mean charge thereon, means for applying an input signal whose frequency is a function of the engine rotational speed to a control electrode of the semiconductor switch, a charge circuit coupling said capacitor to a source of supply voltage by means of said starter switch, means including the semiconductor switch for periodically connecting the capacitor in a discharge circuit at a rate determined by the frequency of said input signal, a starter relay having contacts to complete a circuit for energizing the starter motor upon energization of the starter relay, a semiconductor output amplifier stage having an output coupled to the starter relay and a control electrode responsive to the capacitor charge voltage and operative to energize said starter relay if the mean charge on the capacitor exceeds a predetermined value, the capacitor reaching said predetermined value a predetermined time period after the starter switch is operated and with the engine at rest, said time period being determined by the time constant of the charge circuit, and a frequency-to-DC voltage converter circuit responsive to said input signal and coupled to said semiconductor output amplifier stage to inhibit the operation thereof when said input signal attains a given frequency value and independently of the continued operation of the starter switch.

5. A system as claimed in claim 4 wherein said frequency-to-DC voltage converter circuit includes a thyristor device coupled to the control electrode of the semiconductor output amplifier stage for clamping said control electrode to a voltage potential that will cut-off the output stage when said given frequency value of the input signal occurs, and means coupling the anode-cathode path of the thyristor device to the source of supply voltage via said starter switch.

6. A system as claimed in claim 4 wherein the time constant of the capacitor discharge circuit is shorter than the time constant of its charge circuit.

7. A system as claimed in claim 4 further comprising a second capacitor coupled to said semiconductor output amplifier stage and coupled to said source of supply voltage via the starter switch so as to provide a bias voltage to the output amplifier of a magnitude and polarity tending to maintain conduction in the output amplifier for a relatively short period of time subsequent to the opening of the starter switch.

8. A system as claimed in claim 4 further comprising a latching circuit coupled to the semiconductor output amplifier stage and to the source of supply voltage for holding the output amplifier operative subsequent to its operation in response to the capacitor voltage and during the time the starter switch is operated.

9. A system as claimed in claim 8 including means for coupling the latching circuit to the source of supply voltage via said starter switch.

* * * * *